US009378667B2

(12) United States Patent
Su

(10) Patent No.: US 9,378,667 B2
(45) Date of Patent: Jun. 28, 2016

(54) SCAN DRIVING CIRCUIT

(71) Applicant: SITRONIX TECHNOLOGY CORP., Hsinchu County (TW)

(72) Inventor: Chung-Hsin Su, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 277 days.

(21) Appl. No.: 13/664,661

(22) Filed: Oct. 31, 2012

(65) Prior Publication Data

US 2013/0321363 A1 Dec. 5, 2013

(30) Foreign Application Priority Data

May 29, 2012 (TW) ..... 101119228 A

(51) Int. Cl.
*G09G 3/36* (2006.01)
*G09G 3/00* (2006.01)
*G09G 3/20* (2006.01)

(52) U.S. Cl.
CPC .. *G09G 3/00* (2013.01); *G09G 3/20* (2013.01); *G09G 3/3674* (2013.01); *G09G 2300/0426* (2013.01); *G09G 2310/0286* (2013.01); *G09G 2310/0289* (2013.01)

(58) Field of Classification Search
CPC ..... G09G 3/36; G09G 5/00; G11C 19/00; G06F 3/038; H03K 23/43
USPC ..... 345/87, 98, 99, 100, 204, 690
See application file for complete search history.

(56) References Cited

U.S. PATENT DOCUMENTS

| | | | | |
|---|---|---|---|---|
| 2004/0263461 | A1 | 12/2004 | Park | |
| 2005/0057481 | A1 * | 3/2005 | Chung | 345/100 |
| 2011/0210955 | A1 * | 9/2011 | Chang et al. | 345/212 |
| 2012/0056860 | A1 | 3/2012 | Umezaki et al. | |
| 2013/0010539 | A1 * | 1/2013 | Shim et al. | 365/185.11 |
| 2013/0286763 | A1 * | 10/2013 | Wang | 365/230.06 |

FOREIGN PATENT DOCUMENTS

| | | | |
|---|---|---|---|
| CN | 101577102 | A | 11/2009 |
| CN | 101826864 | A | 9/2010 |
| KR | 10-2005-0000802 | A | 1/2005 |
| KR | 10-2006-0094999 | A | 8/2006 |
| TW | 200836150 | A | 9/2008 |
| TW | 201220275 | A | 5/2012 |

* cited by examiner

*Primary Examiner* — Pegeman Karimi
(74) *Attorney, Agent, or Firm* — Rosenberg, Klein & Lee

(57) ABSTRACT

The present invention relates to a scan driving circuit, which comprises a decoding circuit, a plurality of level-shift driving circuits, and a control circuit. The decoding circuit produces a decoding signal according to a decoding control signal. The plurality of level-shift driving circuits are coupled to the decoding circuit and produce scan signal sequentially according to the decoding signal. The control circuit is coupled to the plurality of level-shift driving circuit. The control circuit produces a first control signal and a second control signal according to the decoding control signal and transmits the first and second control signals to the plurality of level-shift driving circuits for controlling their turning on and off. Accordingly, by means of the control circuit according to the present invention, the circuit area of each level-shift driving circuit can be reduced, and thus the cost can be reduced as well.

7 Claims, 5 Drawing Sheets

SCAN DRIVING CIRCUIT

FIELD OF THE INVENTION

The present invention relates generally to a scan driving circuit, and particularly to a scan driving circuit capable of saving circuit area.

BACKGROUND OF THE INVENTION

In modern times of advanced technological development, liquid crystal displays (LCDs) have been widely applied to electronic display products such as TVs. computer screens, notebook computers, mobile phones, or personal digital assistants (PDAs). An LCD includes data drivers, scan drivers, and an LCD panel. The LCD panel has a pixel array. The scan divers are used for turning on multiple pixel rows in the pixel array sequentially for scanning the pixel data output by the data driver to pixels and thus displaying the image.

A general scan driver comprises a decoding circuit and a plurality of level-shift drivers. The decoding circuit outputs a decoding signal to the plurality of level-shift drivers according to a decoding control signal. The plurality of level-shift drivers produces scan signal sequentially according to the decoding signal for scanning the display panel. In other words, the driving method of the LCD panel is to use a gate as the control for turning on the internal unit. Then a source supplies the accurate voltage for controlling the orientation of liquid crystals in the display panel. Because the output voltage of the gate includes a high voltage (VGH) and a low reference voltage (VGL), high-voltage devices has to be adopted. The scan driving circuit thereof has to raise the scan signal to the high voltage (VGH) and the low reference voltage (VGL) by means of the level-shift drivers. Thereby, the circuit area is larger.

FIG. 1 shows a circuit diagram of a level-shift driver according to the prior art. As shown in the figure, the level-shift driver according to the prior art comprises a first level-shift unit 10', a second level-shift unit 20', and an output driving unit 30'. The first level-shift unit 10' is used for receiving and shifting the level of the decoding signal G1 and transmitting the shifted decoding signal to the second level-shift unit 20'. The level-shifted decoding signal G1 by the first level-shift unit 10' is shifted again. Then, the second level-shift unit 20' transmits the twice-shifted decoding signal G1 to the output driving unit 30'. According to the twice-shifted decoding signal G1, the output driving unit 30' produces the scan signal for scanning the display panel.

Nonetheless, according to the prior art, three levels of level-shift drivers are used for shifting the level of the scan signal. Thereby, at least ten high-voltage transistors and two resistors should be used for completing a set of level-shift drivers. Consequently, the area of the scan driving circuit according to the prior art is increased, and so does the cost.

Accordingly, the present invention provides a novel scan driving circuit, which uses a control circuit for reducing the circuit area of each level-shift driving circuit and thus reducing the cost. The problem described above can be thereby solved.

SUMMARY

An objective of the present invention is to provide a scan driving circuit, which uses a control circuit for reducing the circuit area of each level-shift driving circuit and thus reducing the cost.

The scan driving circuit according to the present invention comprises a decoding circuit, a plurality of level-shift driving circuits, and a control circuit. The decoding circuit produces a decoding signal according to a decoding control signal. The plurality of level-shift driving circuits are coupled to the decoding circuit and produce scan signal sequentially according to the decoding signal. The control circuit is coupled to the plurality of level-shift driving circuit. The control circuit produces a first control signal and a second control signal according to the decoding control signal and transmits the first and second control signals to the plurality of level-shift driving circuits for controlling their turning on and off. Accordingly, by means of the control circuit according to the present invention, the circuit area of each level-shift driving circuit can be reduced, and thus the cost can be reduced as well.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
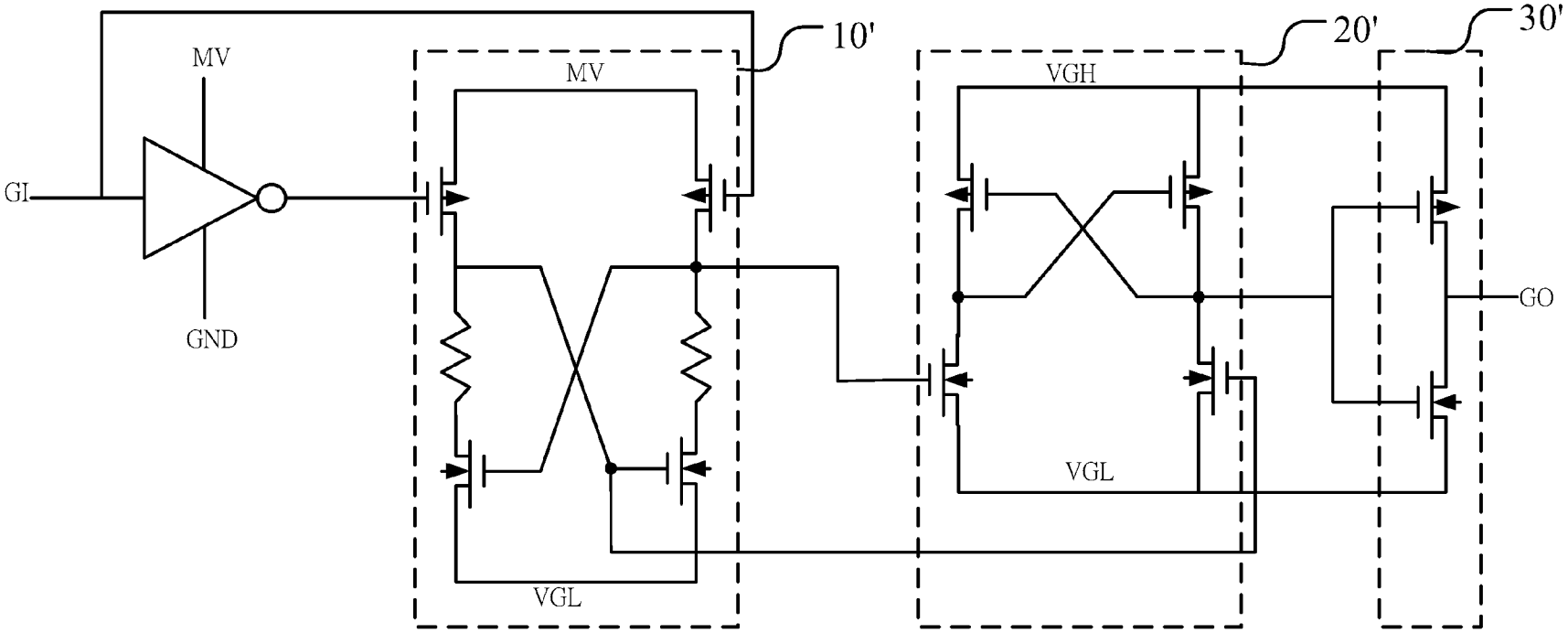
Figure 1(Prior art)
FIG. 1 shows a circuit diagram of a level-shift driver according to the prior art.
Figure 2:
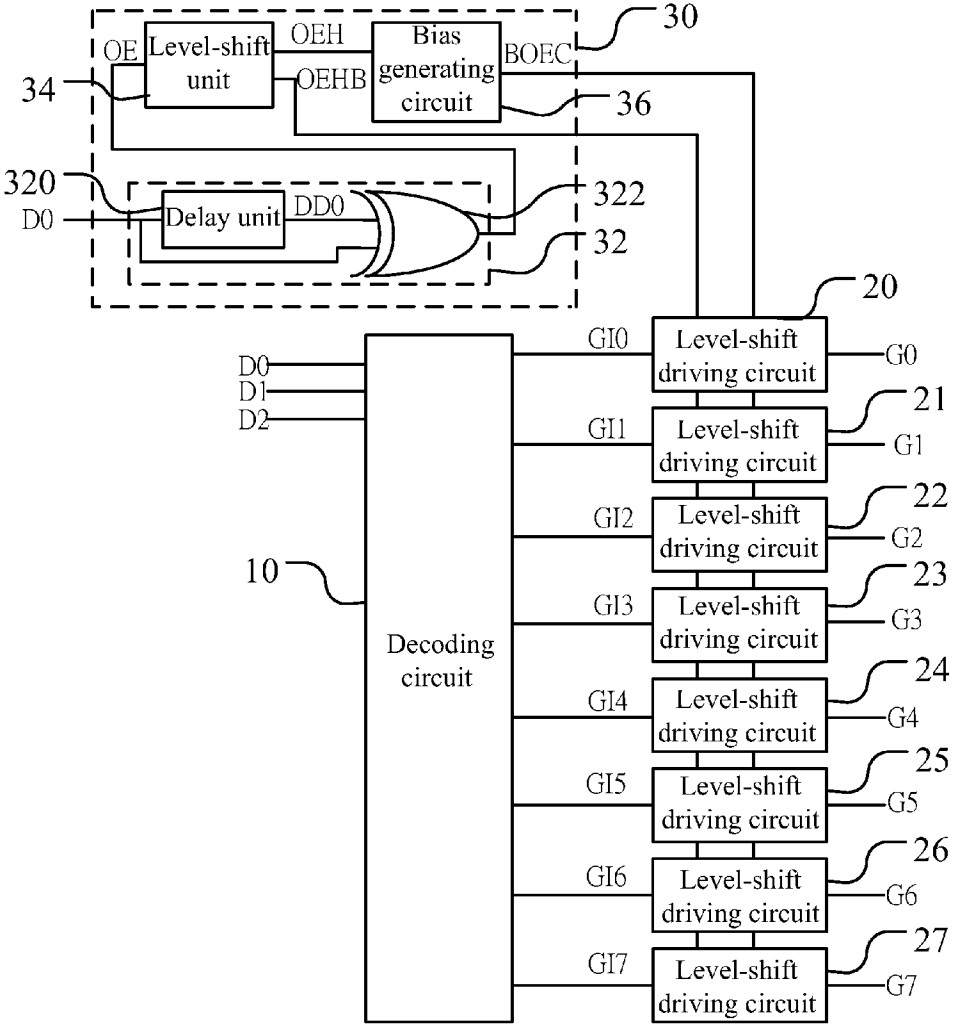
FIG. 2 shows a block diagram of the scan driving circuit according to an embodiment of the present invention.

FIG. 2 shows a block diagram of the scan driving circuit according to an embodiment of the present invention. As shown in the figure, the scan driving circuit according to the present invention comprises a decoding circuit 10, a plurality of level-shift driving circuits 20~27, and a control circuit 30. The decoding circuit 10 produces a decoding signal according to a decoding control signal. According to the present embodiment, the decoding control signal is a 3-bit decoding control signal $D_2D_1D_0$. The decoding circuit 10 produces an 8-bit decoding signal $G1_7$~$G1_0$ according to the 3-bit decoding control signal. Then the decoding circuit 10 transmits the 8-bit decoding signal $G1_7$~$G1_0$ to the plurality of level-shift driving circuits 20~27 for determining which of the plurality of level-shift driving circuits 20~27 to output scan signals $G_0$~$G_7$ sequentially and thus scanning the display panel.

The control circuit 30 is coupled to the plurality of level-shift driving circuits 20~27. The control circuit 30 produces a first control signal BOEC and a second control signal OEHB according to the decoding control signal $D_2D_1D_0$ and transmits the first and second control signals BOEC, OEHB to the plurality of level-shift driving circuits 20~27 for controlling their enabling or disabling. Namely, according to the decoding signal $G_{17}$~$G_{10}$ and the first and second control signals BOEC, OEHB, only one of the plurality of level-shift driving circuits 20~27 will output the scan signal at a time. The first and second control signals BOEC, OEHB produced by the control circuit 30 are used for ensuring cutoff of the plurality of level-shift driving circuits 20~27 before enabling the next-stage level-shift driving circuit to produce the scan signal. For example, when the control circuit 30 produces the first and second control signals BOEC, OEHB and enables the first level-shift driving circuit 20 in the plurality of level-shift driving circuits 20~27, before the control circuit 30 produces the first and second control signals BOEC, OEHB again for enabling the second level-shift driving circuit 21, the control circuit 30 will make sure that the first level-shift driving circuit 20 has been cutoff. Thereby, by using the control circuit 30 according to the present invention, the circuit area of each of the plurality of level-shift driving circuits 20~27 can be reduced and hence the cost can be reduced as well. In the following, the structure of each of the plurality of level-shift driving circuits 20~27 will be described.

Figure 3:
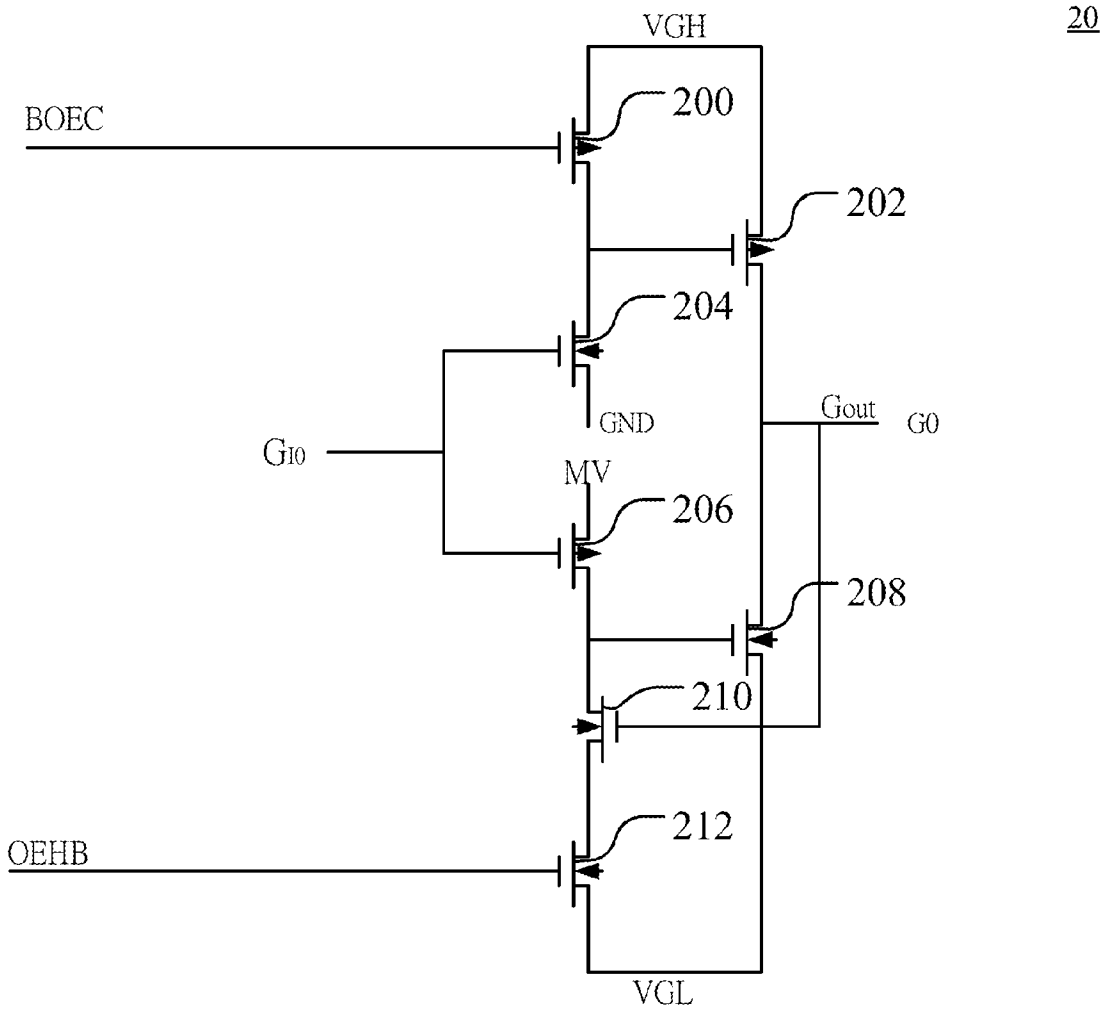
FIG. 3 shows a circuit diagram of the level-shift driver according to an embodiment of the present invention.
Figure 4:
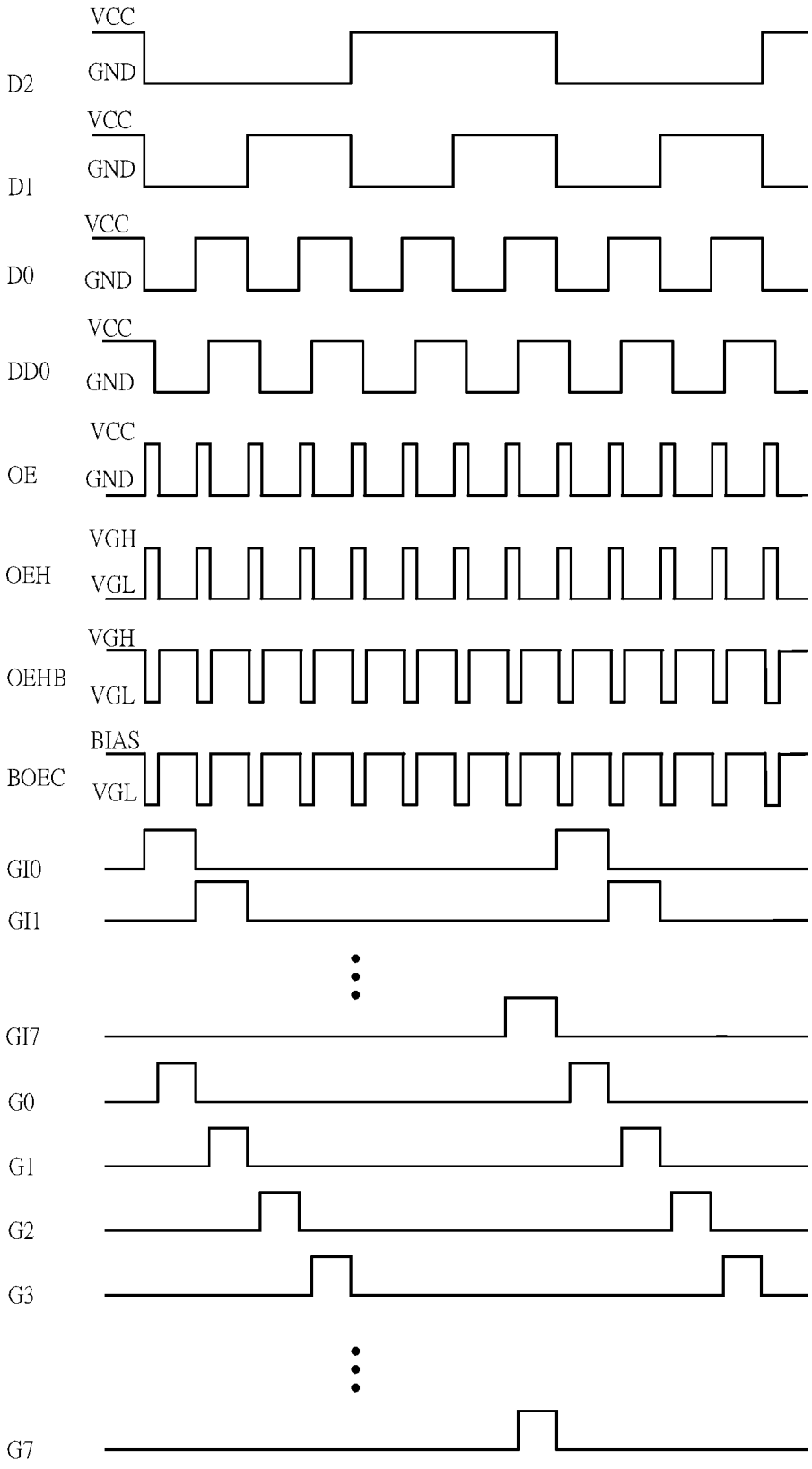
FIG. 4 shows waveforms of the scan driving circuit according to an embodiment of the present invention.

FIG. 3 and FIG. 4 show a circuit diagram of the level-shift driver and waveforms of the scan driving circuit, respectively, according to an embodiment of the present invention. As shown in the figures, taking the first level-shift driving circuit 20 in the plurality of level-shift driving circuits 20~27 as an example, the first level-shift driving circuit 20 according to the present embodiment comprises a first transistor 200, a second transistor 202, a third transistor 204, a fourth transistor 206, a fifth transistor 208, a sixth transistor 210, and a seventh transistor 212. A control of the first transistor 200 is used for receiving the first control signal BOEC. A first terminal of the first transistor 200 is coupled to a first power terminal for receiving a first power supply VGH. A control of the second transistor 202 is coupled to a second terminal of the first transistor 200. A first terminal of the second transistor 202 is coupled to the first power terminal for receiving the first power supply VGH. In addition, the second terminal of the second transistor 202 is coupled to an output Gout of the first level-shift driving circuit 20 for outputting the scan signal G0. A control of the third transistor 204 is used for receiving the decoding signal $G_{10}$ at an input. A first terminal of the third transistor 204 is coupled o the second terminal of the first transistor 200 and the control of the second transistor 202. A second terminal of the third transistor 204 is coupled to a ground GND. A control of the fourth transistor 206 is used for receiving the decoding signal $G_{10}$. A first terminal of the fourth transistor 206 is coupled to a second power terminal for receiving a second power supply MV. A control of the fifth transistor 208 is coupled to a second terminal of the fourth transistor 206. A first terminal of the fifth transistor 208 is coupled to the second terminal of the second transistor 202 and the output Gout. A second terminal of the fifth transistor 208 receives a reference voltage VGL. A control of the sixth transistor 210 is coupled to the output Gout. A first terminal of the sixth transistor 210 is coupled to the second terminal of the fourth transistor 206 and the control of the fifth transistor 208. Besides, a control of the seventh transistor 212 receives the second control signal OEHB. A first terminal of the seventh transistor 212 is coupled to the second terminal of the sixth transistor 210. A second terminal of the seventh transistor 212 receives the reference voltage VGL. In the following, how the first level-shift driving circuit 20 operates will be described.

Refer to FIG. 4. The 3-bit decoding control signal $D_2D_1D_0$ is 000, 001, 010, . . . , 111 sequentially. According to the 3-bit decoding control signal $D_2D_1D_0$, the decoding circuit 10 produces and transmits the decoding signal $G_{10}$~$G_{17}$ to the plurality of level-shift driving circuits 20~27. For example, when the 3-bit decoding control signal $D_2D_1D_0$ is 000, the decoding circuit 10 produces and outputs the high-level decoding signal $G_{10}$ to the first level-shift driving circuits 20 with the other decoding signals $G_{11}$~$G_{17}$ kept low; when the 3-bit decoding control signal $D_2D_1D_0$ is 001, the decoding circuit 10 produces and outputs the high-level decoding signal $G_{11}$ to the second level-shift driving circuits 21 with the other decoding signals $G_{10}$, $G_{12}$~$G_{17}$ kept low. The other conditions can be deduced by analogy.

The control circuit 30 will produce the first and second control signals BOEC, OEHB according to the least significant bit $D_0$ of the decoding control signal $D_2D_1D_0$. In addition, the control circuit 30 will transmit the first and second control signals BOEC, OEHB to the plurality of level-shift driving circuits 20~27, which will produce the scan signal at the output Gout according to the decoding signals $G_{10}$~$G_{17}$ and the first and second control signals BOEC, OEHB. According to the present embodiment, the first level-shift driving circuit 20 in the plurality of level-shift driving circuits 20~27 is used as an example. When the decoding control signal $D_2D_1D_0$ is 000, the decoding circuit 10 produces and outputs the high-level decoding signal $G_{10}$ to the first level-shift driving circuit 20. The input of the first level-shift driving circuit 20 receives the decoding signal $G_{10}$. At this time, the level of the decoding signal $G_{10}$ is high, while the level of the first control signal BOEC is the ground GND and the level of the second control signal OEHB is the reference voltage VGL. Thereby, the first, third, and fifth transistors 200, 204, 208 are turned on, while the second, fourth, sixth, and seventh transistors 202, 206, 210, 212 are cutoff. Hence, the level of the scan signal G0 at the output Gout of the first level-shift driving circuit 20 is low. Then, the voltage levels of the scan driving circuit and the driving circuits 20~27 will all not out the scan signal for ensuring that the voltage levels and the driving circuits 20~27 are all shut off.

Then, the level of the decoding signal $G_{10}$ is still high. The level of the first control signal BOEC is changed from low (namely, GND) to high (namely, the BIAS voltage); the level of the second control signal OEHB is changed from low (namely, the reference voltage VGL) to high (namely, VGH). Thereby, the first transistor 200 is turned on with a fixed current flowing through; the third transistor 204 is turned on, which makes the second transistor 202 also being turned on. Thus, the scan signal G0 at the output Gout is raised. Originally, the fourth and sixth transistors 206, 210 are cutoff and the fifth and seventh transistors 206, 210 are turned on. When the scan signal G0 at the output Gout is raised, the sixth transistor 210 is changed form the cutoff state to the turned-on state. The turning on of the sixth transistor 210 cuts off the fifth transistor 208 and changes the level of the scan signal G0 at the output Gout to VGH. When the decoding control signal $D_2D_1D_0$ is changed from 000 to 001, the decoding circuit 10 produces and outputs the decoding signal $G_{17}G_{16}G_{15}G_{14}G_{13}G_{12}G_{11}G_{10}$, which is changed from 00000001 to 00000010, to the first level-shift driving circuit 20. The level of the decoding signal $G_{11}$ is changed to high. At this moment, the level of the first control signal BOEC is the ground GND level, making the first transistor 200 in the level-shift driving circuits 20~27 changed from the turn-on state with a fixed current flowing through to the fully turn-on state. The level of the second control signal OEHB is the ground GND, making the seventh transistor 212 in the level-shift driving circuits 20~27 changed from the turn-on state to the cutoff state. The level of $G_{10}$ in the decoding signal $G_{17}G_{16}G_{15}G_{14}G_{13}G_{12}G_{11}G_{10}$ is changed from high to low, and thereby the third transistor 204 in the first level-shift driving circuits 20 is changed from the turn-on state to the cutoff state; the second transistor 202 is changed from the turn-on state to the cutoff state; the fourth transistor 206 is changed from the cutoff state to the turn-on state; and the fifth transistor 208 is changed from the cutoff state to the turn-on state. Besides, the level of the scan signal G0 at the output Gout is pulled from the level of the first power supply VGH to the level of the reference voltage VGL; and the sixth transistor 210 is changed from the turn-on state to the cutoff state. At this time, the scan signal G7G6G5G4G3G2G1G0 at the output Gout of the plurality of level-shift driving circuits 20~27 is changed from 00000001 to 00000000. After a short period, the level of the first control signal BOEC is changed from low (namely, GND) to high (namely, the BIAS voltage); the level of the second control signal OEHB is changed from low (namely, the reference voltage VGL) to high (namely, the first power supply VGH). Thereby, the first transistor 200 in the plurality of level-shift driving circuits 20~27 is in the turn-on state with a fixed current flowing through and the third transistor 204 is in the turn-on state. Nonetheless, because the level of the decoding signal $G_{11}$ is high, the third transistor 204 in the level-shift driving circuit 21 is in the turn-on state, which turns on the second transistor 202. Thereby, the scan signal G0 at the output Gout will be raised. Originally, the fourth transistor 206 and the sixth transistor 210 are cutoff and the fifth transistor 208 and the seventh transistor 212 are turned on. Because the scan signal G0 at the output Gout is raised, the sixth transistor 210 will be changed from the cutoff state to the turn-on state, which will cut off the fifth transistor 208 and change the level of the scan signal at the output Gout to the level of the first power supply VGH. Consequently, the level of the scan signal G1 at the output Gout of the next level-shift driving circuit 21 will be changed from the reference voltage VGL to the first power supply VGH. Hence, the scan signal G6G5G4G3G2G1G0 at the outputs Gout of the plurality of level-shift driving circuit 21~27 will be changed from 00000001 to 00000000, and then to 00000010, and so on.

Refer again to FIG. 2. The control circuit 30 according to the present invention comprises an enable circuit 32 and a level-shift unit 34. The enable circuit 32 is used for receiving and producing an enable signal OE according to the decoding control signal $D_2D_1D_0$. The level-shift unit 34 is coupled to the enable circuit 32 and shifts the level of the enable signal OE for producing the first and second control signals BOEC, OEHB. The enable circuit 32 includes a delay unit 320 and a logic unit 322. The delay unit 320 is used for delaying the least significant bit $D_0$ of the decoding control signal $D_2D_1D_0$ and producing a delay signal DD0. The logic unit 322 has a first input and a second input. The first input of the logic unit 322 is used for receiving the delay signal DD0; the second input of the logic unit 322 is used for receiving the least significant bit $D_0$ of the decoding control signal $D_2D_1D_0$. The logic unit 322 produces the enable signal OE according to the delay signal DD0 and the least significant bit $D_0$ of the decoding control signal $D_2D_1D_0$. According to the present embodiment. the logic unit 322 is an XOR gate. Of course, the XOR gate according to the present embodiment can be replaced by another logic circuit. A person having ordinary skill in the art can easily modify it. Accordingly, the related technologies of producing the enable signal OE by using the logic unit 322 according to the present embodiment and according to the least significant bit $D_0$ of the decoding control signal $D_2D_1D_0$ are all within the scope of the present invention.

Moreover, the control circuit 30 according to the present invention further comprises a bias generating circuit 36 coupled to the level-shift unit 34 and producing the first control signal BOEC according to an output signal OM of the level-shift unit 34. Besides, the bias generating circuit 36 generates a bias current within the plurality of level-shift driving circuits 20~27. Refer to FIG. 3 again. Because when the first and third transistors 200, 204 are cut off simultaneously, the node voltage therebetween is floating, which makes the turn-on and cutoff states of the second transistor 202 unclear and thus affecting the operation of the whole level-shift driving circuits 20~27. Thereby, the bias generating circuit 36 still generates a bias current when the first transistor 200, which is in the turn-on state or the turn-on state with a fixed current, is cutoff simultaneously with the third transistor 204. The bias current will flow through the first transistor 200 to maintain the node voltage between the first and third transistors 200, 204 at a fixed voltage such as the first power supply VGH or the ground GND and thus keeping the second transistor 202 in the cutoff or turn-on state. Accordingly, by using the bias current generated by the bias generating circuit 36, error actions by the level-shift driving circuit s 20~27 can be avoided.

Figure 5:
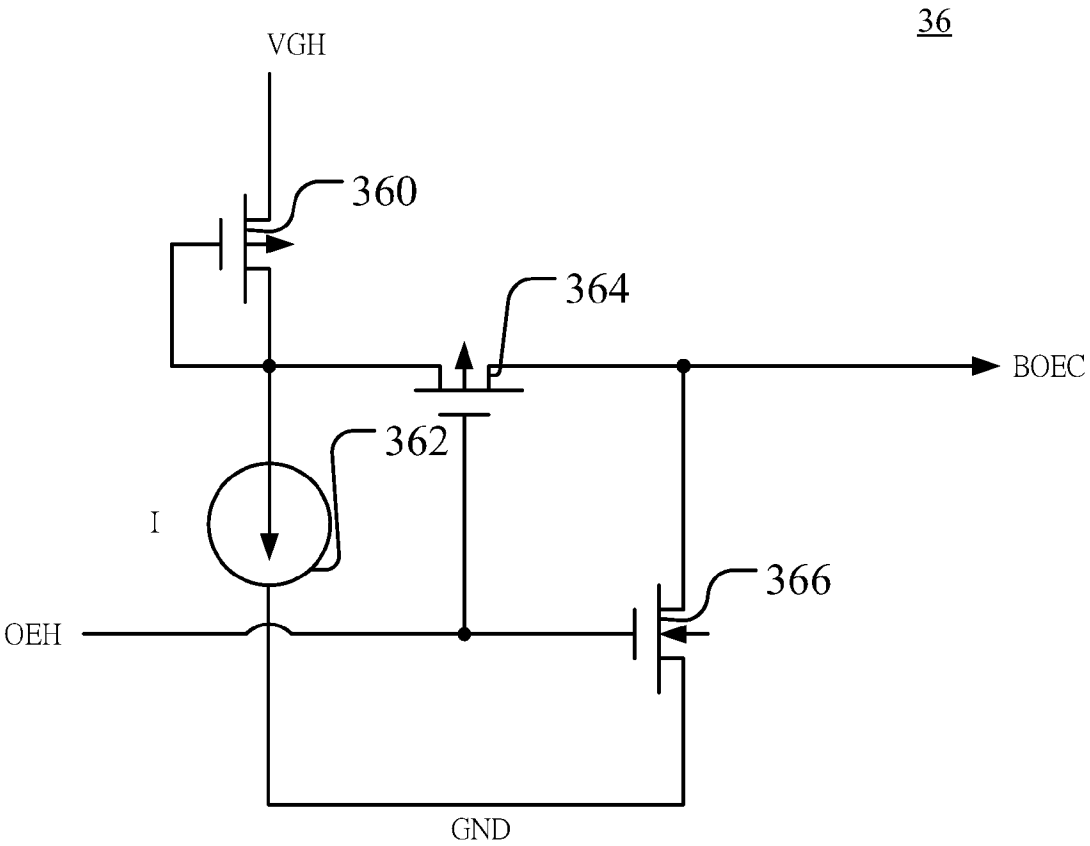
FIG. 5 shows a circuit diagram of the bias generating circuit according to an embodiment of the present invention.

FIG. 5 shows a circuit diagram of the bias generating circuit according to an embodiment of the present invention. As shown in the figure, the bias generating circuit 36 according to the present invention comprises a first impedance device 360, a first current source 362, a first switch 364, and a second switch 366. A first terminal of the first impedance device 360 is coupled to the first power terminal for receiving the first power supply VGH. A first terminal of the first current source 362 is coupled to a second terminal of the impedance device 360; a second terminal of the first current source 362 is coupled to the ground GND. A first terminal of the first switch 364 is coupled to the second terminal of the first impedance device 360 and the first terminal of the first current source 362. In addition, the second terminal of the first switch 364 is coupled to an output of the bias generating circuit 36. The first switch 364 is controlled by the output signal OEH of the level-shift unit 34. A first terminal of the second switch 366 is coupled to the output of the bias generating circuit 36; a second terminal of the second switch 366 is coupled to the ground GND. The second switch 366 is controlled by the output OEH of the level-shift unit 34. Besides, the bias generating circuit 36 according to the present embodiment is a current mirror circuit. Accordingly, the bias generating circuit 36 according to the present invention can generate bias current for avoiding error actions in the level-shift driving circuits 20~27.

To sum up, the scan driving circuit according to the present invention comprises a decoding circuit, a plurality of level-shift driving circuits, and a control circuit. The decoding circuit produces a decoding signal according to a decoding control signal. The plurality of level-shift driving circuits are coupled to the decoding circuit and produce scan signal sequentially according to the decoding signal. The control circuit is coupled to the plurality of level-shift driving circuit. The control circuit produces a first control signal and a second control signal according to the decoding control signal and transmits the first and second control signals to the plurality of level-shift driving circuits for controlling their turning on and off. Accordingly, by means of the control circuit according to the present invention, the circuit area of each level-shift driving circuit can be reduced, and thus the cost can be reduced as well.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A scan driving device, comprising:

a decoding circuit, producing a decoding signal according a decoding control signal;

a plurality of level-shift driving circuits, coupled to said decoding circuit, and producing a scan signal according to said decoding signal; and a control circuit, coupled to said plurality of level-shift driving circuits, receiving said decoding control signal and said decoding control signal is used to generate a first control signal and a second control signal, and transmitting said first control signal and said second control signal to said plurality of level-shift driving circuits for controlling enabling or cutoff of said plurality of level-shift driving circuits;

wherein said control circuit comprises an enable circuit and a level-shift unit, said enable circuit receives and produces an enable signal according to said decoding control signal, said level-shift unit is coupled to said enable circuit, and shifts a level of said enable signal for producing said first control signal and said second control signal.

2. The scan driving device of claim 1, wherein said decoding circuit produces said decoding signal according to a least significant bit of said decoding control signal.

3. The scan driving device of claim 1, wherein said level-shift driving circuit comprises:

a first transistor, having a control for receiving said first control signal, and having a first terminal coupled to a first power terminal;

a second transistor, having a control coupled to a second terminal of said first transistor, having a first terminal coupled to said first power terminal, and having a second terminal coupled to an output of said level-shift driving circuit;

a third transistor, having a control for receiving said decoding signal, having a first terminal coupled to said second terminal of said first transistor and said control of said second transistor, and having a second terminal coupled to a ground;

a fourth transistor, having a control for receiving said decoding signal. and having a first terminal coupled to a second power terminal;

a fifth transistor, having a control coupled to a second terminal of said fourth transistor, having a first terminal coupled to said second terminal of said second transistor and said output, and having a second terminal for receiving a reference voltage;

a sixth transistor, having a control coupled to said output, having a first terminal coupled to said second terminal of said fourth transistor and said control of said fifth transistor; and a seventh transistor, having a control or receiving said second control signal, having a first terminal coupled to a second terminal of said sixth transistor, and having a second terminal for receiving said reference voltage.

4. The scan driving device of claim 1, wherein said control circuit further comprises a bias generating circuit, coupled to said level-shift unit, and producing said first control signal according an output signal of said level-shift unit.

5. The scan driving device of claim 4, wherein said bias generating circuit is a current mirror circuit.

6. The scan driving device of claim 4, wherein said bias generating circuit comprises:

an impedance device, having a first terminal coupled to said first power terminal;

a current source, having a first terminal coupled to a second terminal of said impedance device, and having a second terminal coupled to said ground;

a first switch, having a first terminal coupled to said second terminal of said impedance device and said first terminal of said current source, having a second terminal coupled to an output of said bias generating circuit, and controlled by said output signal of said level-shift unit; and a second switch, having a first terminal coupled to said output of said bias generating circuit, having a second terminal coupled to said ground, and controlled by said output signal of said level-shift unit.

7. The scan driving device of claim 1, wherein said enable circuit comprises:

a delay unit, used for delaying said decoding control signal; and a logic unit, having a first terminal coupled to said delay unit for receiving said delayed decoding control signal, having a second terminal for receiving said decoding control signal, and producing said enable signal according said decoding control signal and said delayed decoding control signal.

* * * * *